United States Patent [19]

Hayes

[11] Patent Number: 4,489,304

[45] Date of Patent: Dec. 18, 1984

[54] SPRING DISCONNECT MECHANISM FOR SELF CENTERING MULTIPLE AXIS ANALOG CONTROL STICK

[76] Inventor: Charles L. Hayes, 770 Comwell Way, Vista, Calif. 92083

[21] Appl. No.: 516,300

[22] Filed: Jul. 22, 1983

[51] Int. Cl.[3] ..... H01C 10/16; G05G 9/00

[52] U.S. Cl. ..... 338/128; 74/471 XY

[58] Field of Search ..... 200/6 A; 338/128, 129, 338/130, 131, 134, 160; 74/471 R, 471 XY

[56] References Cited

U.S. PATENT DOCUMENTS

| | | | |
|---|---|---|---|
| 2,929,258 | 3/1960 | Mackway | 74/471 |
| 3,365,975 | 1/1968 | Hathaway | 74/471 R |
| 3,394,611 | 7/1968 | Beurrier | 74/471 R |
| 3,939,451 | 2/1976 | Kasahima | 338/128 |
| 4,042,902 | 8/1977 | Meyer et al. | 338/128 |
| 4,093,953 | 6/1978 | Hammons et al. | 74/526 X |
| 4,101,863 | 7/1978 | Lewicki | 74/471 X |
| 4,275,611 | 6/1981 | Asher | 338/128 |
| 4,325,050 | 4/1982 | Suszynski | 338/128 |
| 4,375,631 | 1/1983 | Goldberg | 74/471 XY |

FOREIGN PATENT DOCUMENTS

| | | | |
|---|---|---|---|
| 2704596 | 8/1978 | Fed. Rep. of Germany | 338/128 |

*Primary Examiner*—J. R. Scott

*Attorney, Agent, or Firm*—Brown & Martin

[57] ABSTRACT

A mechanism for connecting and disconnecting return springs for multiple axis analog control sticks. The control stick, movable in two axes, can be fully spring centered along both axes, spring centered along one axis and frictionally positioned along the other axis, or freely frictionally positioned along both axes. Externally accessible pins are selectably operable to engage or disengage the centering springs to change control stick modes. Additionally, motion of the control stick in one or both axes may be substantially inhibited by the pins.

10 Claims, 6 Drawing Figures

SPRING DISCONNECT MECHANISM FOR SELF CENTERING MULTIPLE AXIS ANALOG CONTROL STICK

FIELD OF THE INVENTION

This invention relates generally to analog control devices and more particularly concerns spring centered joysticks.

BACKGROUND OF THE INVENTION

Multiple axis analog control sticks, commonly called joysticks, are available and adapted for use for a large number of purposes. For example, they are employed for controls in computer peripherals, video games, cursor positioning, wheelchair controls, medical equipment and remote controls for models. Normally two orthogonally related potentiometers are controlled by the joystick. Control stick assemblies are employed to generate electrical signals representative of the coordinates of control stick displacement. Typically complex displacement of the control stick is resolved into components along two orthogonal axes corresponding to the axes of rotation of the input shafts of two orthogonally disposed potentiometers and electrical signals proportional to this displacement are generated across the terminals of the potentiometers.

These devices may be individual housing or panel-mounted and incorporate multiple functions in a single unit. Typically, either the single or multiple axis devices have been spring biased so that they automatically return to a center or null position upon release of lateral pressure on the joystick. There are instances where it is desired to permit the control stick to remain in any off center position. In these instances it has been necessary to remove the back of the control stick housing and disconnect the appropriate return spring, thereby allowing the stick to be placed in any position along the disconnected spring axis and remain in that position.

SUMMARY OF THE INVENTION

It is a primary object of this invention to enable the return springs of a joystick to be externally connected or disconnected to permit versatility in the use and operation of the joystick.

The control mechanism of this invention includes an elongated stick having an interior extension engaging a pair of pivoted orthogonally related bails. Each of the bails is associated with a pair of pivoted spring arms connected together by means of a tension spring. Whenever a bail is moved from its neutral or center position by means of a lateral force applied to the joystick, the bail and the joystick will be returned to center upon release of the force due to the bias of the spring. A positive disconnect means comprises a pin rotatably mounted to the base of the control housing which, when the spring is extended in one direction, engages the spring arm and prevents it from returning to the central or null position. When both arms associated with a single bail are thereby locked out, the bail is free to pivot in either direction and no bias means is applied to it to return it and the connected joystick to center.

This disconnect function can operate in either or both axes thereby freeing the joystick in only one direction or in all directions. The joystick is mounted to a ball and socket pivot and the bail and potentiometer combination have a combined positive frictional state so that the stick will remain wherever it is set when the springs are disconnected. Alternatively, the spring disconnect means may be operated to inhibit movement of the joystick.

BRIEF DESCRIPTION OF THE DRAWING

The objects, advantages and features of this invention will be more readily appreciated from the following detailed description when read in conjunction with the accompanying drawing, in which.

DESCRIPTION OF THE PREFERRED EMBODIMENT

Figure 1:
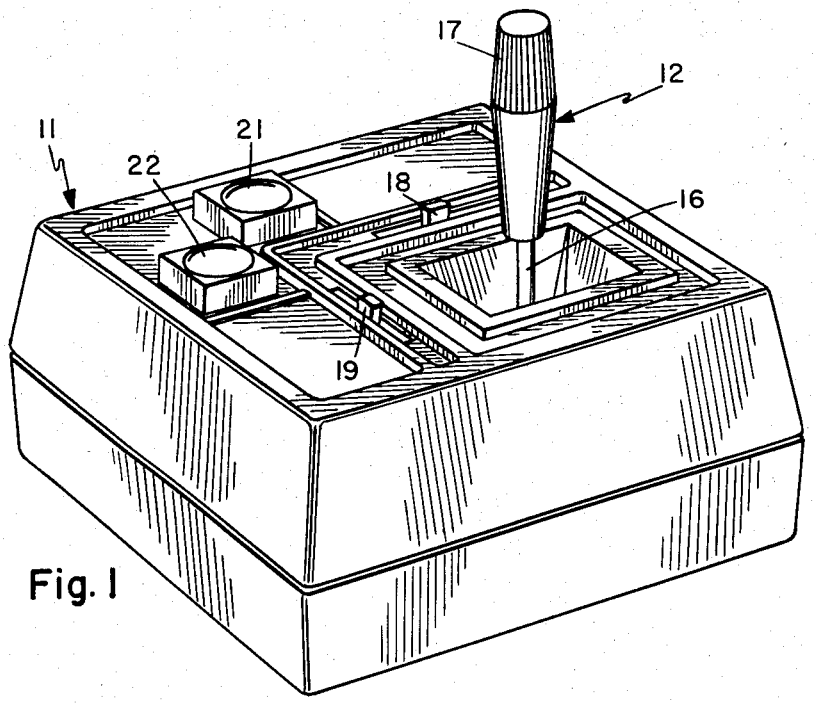
FIG. 1 is a perspective view of the control stick module of this invention mounted in a housing.

With reference now to the drawing, and more particularly to FIG. 1 thereof, there is shown a housing 11 having integrally mounted therein control stick or joystick assembly 12. Mounting bezel 13 has a cone 14, which is shown substantially square but could be round, extending downwardly below the surface of the control housing and has a center opening in which is mounted a ball 15 to which stick shaft 16 is connected. The ball is pivotally retained in a conventional socket arrangement. Stick tip 17 is shown as a simple knob or handle. However, it may take on any desired form including having fine or coarse knurling and it may have an axially movable button in the end for additional electrical controls. Depressible buttons 21 and 22 are also provided on the top surface of the control housing for additional electrical functions not relevant to this invention.

Figure 2:
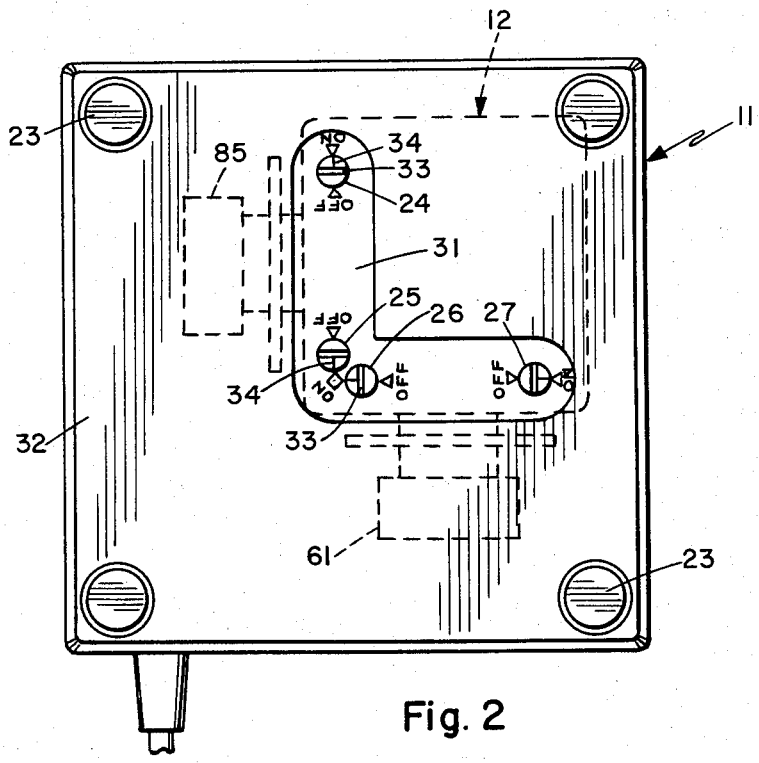
FIG. 2 is a bottom view of the housing of FIG. 1.
Figure 3:
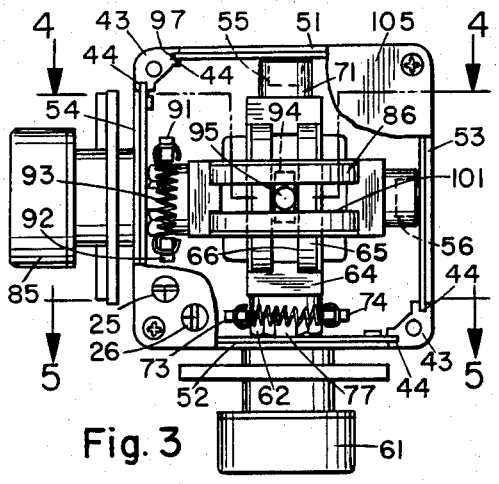
FIG. 3 is a bottom view, partially cut away, of the control stick module.
Figure 4:
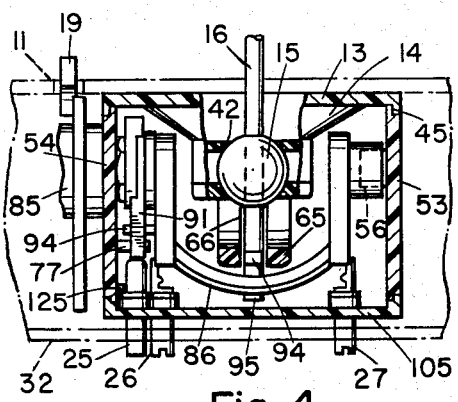
FIG. 4 is a sectional view taken on line 4—4 of FIG. 3.

While the joystick of this invention may be panel mounted, the device shown in FIGS. 1 and 2 is a self contained unit in housing 11. Cushioned feet 23 are provided on the bottom of the housing as shown in FIG. 2. Spring disconnect pins 24, 25, 26 and 27 project downwardly slightly from recessed area 31 in bottom 32 of the control housing. These pins could be wholly within the housing, accessible through openings aligned with each one. Each pin is formed with a cross slot 33 and orientation indicator 34. Printed indicia on the surface 31 indicates "ON" and "OFF" positions for each spring disconnect pin. The functions of these pins and the indicia are set out below.

With reference now to FIGS. 3–6, the components of the joystick control module will be detailed. The module housing comprises top bezel surface 13 having depressed cone 14 with a central opening 42 therein. Projecting downwardly from the four corners of the bezel are corner posts 43 each having a pair of longitudinal grooves 44 facing the adjacent two corner posts. There is also a groove 45 in the undersurface of flat bezel 13 between and aligned with slots 44 in the corner posts. Mounted in the slots 44 in the corner posts and in lower bezel slot 45 are side panels 51, 52, 53, and 54. Side panels 51 and 53 are formed with bushings 55 and 56 respectively.

Potentiometer 61 is mounted in an opening through side panel 52 and is secured thereto by appropriate means such as a nut 62. The potentiometer is normally rotatable with respect to the panel so that its output signal may be precisely trimmed by means of tabs 18 and 19 (FIG. 1). Projecting beyond the internal face of panel 52 and connected to the shaft of potentiometer 61 is bail 64 having an arcuate portion 65 with a coextensive arcuate slot 66. The proximal end of the bail is pivotally mounted to the shaft of potentiometer 61 by appropriate means such as a screw (not shown). The distal end of the bail is formed with a socket 71 which is adapted to fit freely over bushing 55 in side panel 51. Similarly, potentiometer 85 is mounted to panel 54 with arcuate bail 86 connected to the shaft of the potentiometer for rotation therewith.

Positioned between side panel 52 and vertical bail portion 72 are two spring arms 73 and 74 having spring engaging notches 75 and 76 respectively at their distal ends. Similar spring arms 91 and 92 are associated with bail 86. Extending inwardly from plate 52 is projection 77 which acts as a stop for spring arms 73 and 74. The facing surfaces 81, 82 of the spring arms make contact with the projection when the assembly is in neutral position (FIG. 5) and tension spring 83 has pulled the spring arms as closely together as possible. Projecting toward panel 52 from bail portion 72 is extension 84 which also engage faces 81, 82 of the spring arms.

When the bail, due to lateral forces applied to the joystick, is rotated toward spring arm 73 (FIG. 5), extension 84 engages surface 81 and rotates the spring arm away from projection 77. This acts against the biasing action of spring 83 so there is a constant centering force applied to the bail. When the external force on the joystick is released, the spring will cause the spring arm and the bail to return to the central or neutral position. The same is true if the bail moves toward spring arm 74. The action of the bail, in connection with this mounting to the shaft of potentiometer 61, is a frictional motion so that absent the biasing action of spring 83, the bail remains in whatever position it is placed. Thus, when the spring is disconnected from the spring arms, or one of the spring arms is held outwardly, the action of the spring is negated and the bail is free to move wherever desired and will remain in that position.

Likewise, bail 86, while shaped somewhat differently to fit around and outside of bail 64, is connected, together with spring arms 91, 92 and spring 93 to the shaft of potentiometer 85 in the manner similar to that previously described with respect to the other potentiometer bail and side panel.

Stick shaft 16 is mounted to ball 15 and projecting inwardly beyond ball 15 is cross head 94. Projecting beyond cross head 94 is axial projection 95, the function of which will be made clear presently. When potentiometer 61 and panels 51 and 52 are interconnected through bail 64, the reduced thickness edges 97 of the panels slidingly fit within opposite slots of 44 on corner posts 43, with cross head 94 being confined within slot 66 of bail 64 so that stick 16 can freely move in one plane without affecting spring 83. Similarly, when potentiometer 85 and side panel 54 to which it is mounted are assembled with side panel 53 through bail 86, the reduced thickness portions of the panels are slidingly received in slots or grooves 44 in the opposite corner posts 43. When thus assembled, axial projection 95 of the control stick is confined within slot 101 in bail 86 which is now oriented at a 90° angle with respect to slot 66 in bail 64. Note that cross head 94 is not essential for proper operation of the control stick, but it provides a preferred "feel" to operators because it prevents rotation of the stick. No matter the direction of motion of the stick due to lateral forces being applied to it, the stick maintains rotational stability.

With this arrangement, and springs 83 and 93 connected to the appropriate spring arms, stick shaft 16 is centered or located in the neutral position unless and until a lateral force is applied to the stick.

Base 105 is secured to the assembly housing by means of screws connecting it to corner posts 43. The base is formed with four bores which receive the upper portions of spring disconnect pins 24–27. Each pin, for example, pin 27, is formed with a collar 115 which allows the top portion 116 of the pin to extend through the bore for a predetermined distance, with collar 115 engaging bushing 117 extending downwardly or inwardly from the bottom surface of base 105. The same is true for each of the other three pins. Each pin has a chordal longitudinal extension 121 having opposite surfaces 122 and 123, both of which may be arcuate for smooth functioning. Ridge 124 across extension 121 adjacent the base thereof is for strength purposes. When base 105 is assembled to the control housing, the bottom side of collar 115 is directly adjacent inwardly projecting tab 125 (FIG. 4) on panel 54, whereby pin 25 is confined between tab 125 and bushing 117 and is substantially prevented from axial motion when the control module is fully assembled.

With the spring disconnect pins turned to the "ON" positions as shown in FIG. 2 (each indicator 34 adjacent the "ON" indicia), the spring arms can freely move about their pivots and the springs function to bias the control stick to the center position. If it is desired to remove the spring bias from one or more planes of motion of the control stick, the control stick is moved to its most distant point in one plane (FIG. 5) and the disconnect pin farthest from the position of the control stick in a plane parallel to the control stick plane is rotated 180°, whereby extension 121 closely abuts the inner distal end of spring arm 73 preventing its return to the central position (see FIG. 6). If the control stick is moved in the opposite direction in the same plane and the same procedure is accomplished with disconnect pin 27, spring 83 will be completely disabled and the control stick will be freely movable in that plane and will remain in any position to which it is placed without any biasing action by any other member. If this is done for both springs, the control stick is then freely movable to any position with no bias toward the neutral or central position. The pins are frictionally seated in base 105 and can be rotated by means of a screwdriver inserted into cross slot 33.

To re-engage the effect of springs 83 and 93, pins 24–27 need only be rotated 180° and the spring arms will snap back to their bail engaging positions providing a centering bias on the position of control stick 16. Thus it is possible by only disengaging one spring arm to allow the joystick free movement in only one direction in one plane. Alternatively, by disengaging more than one spring arm, the stick can freely move in both directions in one plane or any combination of directions in the two orthogonal planes.

Figure 5:
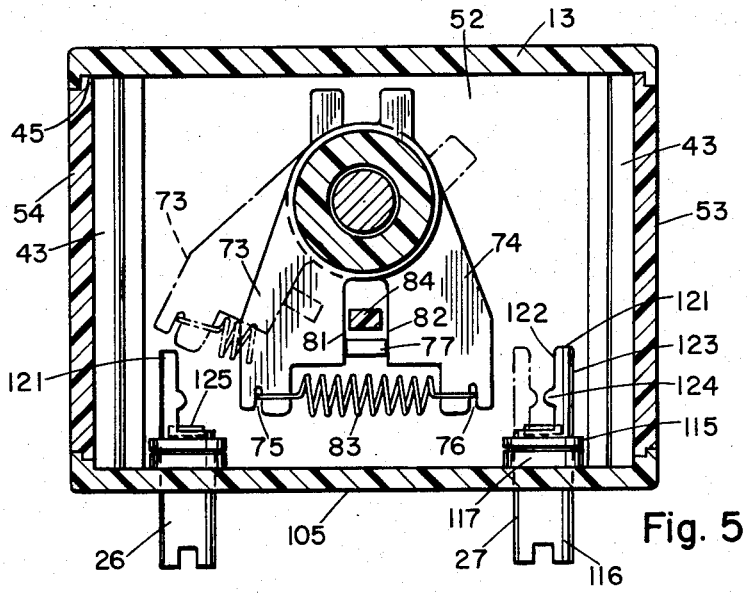
FIG. 5 is an enlarged sectional view taken on line 5—5 of FIG. 3.
Figure 6:
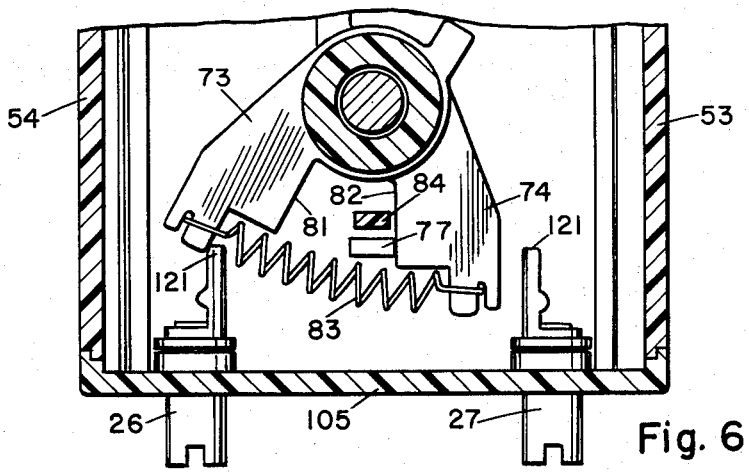
FIG. 6 is a view similar to FIG. 5, with the control stick locked against substantial movement in one direction and free of the centering spring in the other direction.

An additional feature of the invention is that the spring disconnect pins may be used to limit motion of the control stick. As shown in FIG. 5, if pin 27 is rotated 180° when the stick is in the neutral position, motion of the stick in the direction opposite to that pin is blocked by extension 121 abutting spring arm 74. This motion limitation is removed by again rotating pin 27 out of engagement with the spring arm.

The module housing is shown as formed of several parts, including panels that slidingly engage corner posts, for ease of assembly. It is possible that the housing could be differently constructed. Additionally, pivotal means other than a ball and socket may be used for the joystick, and the variable output signal means may be a device other than a potentiometer.

The unique structure of this invention shows the disconnect pins extending through the module base. It is possible that in certain instances the side may be accessible where the base is not. Similar rotatable pins could, therefore, be mounted through the side panels to engage the spring arms.

In view of the above description it is likely that modifications and improvements will occur to those skilled in the art which are within the scope of the accompanying claims.

What is claimed is:

1. A spring disconnect mechanism for self centering control sticks, said mechanism comprising;

a housing comprising;

a top bezel;

side panels forming a rectangular cavity with said bezel; and a base spaced from said bezel and enclosing the interior of said cavity;

a pair of output signal varying devices, one mounted to each of two adjacent said side panels, the control shaft of each said signal varying device extending into said housing;

a control stick pivotally mounted to said bezel and extending from outside into said housing;

orthogonally arranged bail means mounted within said housing, one being connected to each said signal varying device control shaft for rotation therewith, the inner end of said control stick engaging said bails;

springs means for normally biasing each said bail to the central position; and means for selectively engaging said spring means, said engaging means being accessible externally of said housing and being effective to selectively connect and disconnect said spring means with respect to said bails;

whereby said control stick may be fully biased to the center position, and may selectively be freely movable in any desired plane without being subject to any biasing forces.

2. The mechanism recited in claim 1 wherein said housing further comprises:

corner posts formed with longitudinal grooves facing each other from adjacent posts;

said panels having reduced thickness ridges each engaging two adjacent said grooves and laterally innerconnecting two adjacent said posts.

3. The mechanism recited in claim 1 wherein said signal varying devices are potentiometers which are rotatable with respect to said side panels.

4. The mechanism recited in claim 1 wherein said spring means comprises;

spring arms pivotally connected at their proximal ends about the axes of said signal varying device shafts;

a tension spring connected between the distal ends of two commonly pivoted spring arms;

spring arm engaging means on said bail extending between said spring arms;

whereby pivotal motion of said bail forces one of said spring arms away from the commonly pivoted second spring arm and against the biasing action of said spring.

5. The mechanism recited in claim 4 wherein said connecting and disconnecting means comprises:

a plurality of pins mounted in said base and rotatable between a first position and a second position, each said pin being adapted to engage one of said spring arms when said spring arm is forced away from the center position by motion of said control stick and said bail, said first position of said pin being the spring arm engaging position, said pin being rotatable to a second position disengaging said spring arm;

whereby when said spring arm is engaged by said pin, said control stick is freely movable in the direction parallel to and opposite from the off center position of said spring arm.

6. The mechanism recited in claim 5 wherein when each of said spring arms is engaged by one of said pins, said control stick is freely movable about its pivot point.

7. The mechanism recited in claim 5 wherein:

said base is formed with a bore therethrough;

each said pin is formed with a radially extending collar preventing said pin from moving beyond a predetermined position outwardly through said bore; and said housing is formed with an inwardly extending projection engaging the longitudinally opposite side of said collar, whereby said collar prevents said pin from moving axially with respect to said housing.

8. The mechanism recited in claim 6 and further comprising:

an inwardly extending projection parallel to and spaced from the axis of each said potentiometer on each said panel;

said projection being arranged with respect to said spring arms whereby when said bail moves one said spring arm away from the center position, the second said spring arm engages said projection so that pivotal movement of said second spring arm in the direction of said bail is prevented.

9. The mechanism recited in claim 1 wherein:

said bezel is formed with a cone shaped depression;

said pivot mounting for said control stick comprises a ball and socket arrangement, said control stick extending through an opening at the apex of said cone.

10. The mechanism recited in claim 1 wherein:

said control stick is formed with a cross head adjacent its inner end, said cross head slidingly engaging one of said bails and thereby preventing rotation of said control stick;

said control stick being further formed with an axial projection beyond said cross head, said axial projection slidingly engaging the other of said bails.

* * * * *